US007726852B2

(12) United States Patent
Sanoner et al.

(10) Patent No.: US 7,726,852 B2
(45) Date of Patent: Jun. 1, 2010

(54) CANOPY LIGHT

(75) Inventors: Hughes Sanoner, Hong Kong (HK); Desmond Wai Nang Tse, Hong Kong (HK); Lawrence Chi Hang Chan, Hong Kong (HK)

(73) Assignee: Solar Wide Industrial Ltd., Tsuen Wan, New Territories (HK)

( * ) Notice: Subject to any disclaimer, the term of this patent is extended or adjusted under 35 U.S.C. 154(b) by 0 days.

(21) Appl. No.: 11/851,636

(22) Filed: Sep. 7, 2007

(65) Prior Publication Data

US 2009/0067165 A1 Mar. 12, 2009

(51) Int. Cl.
*F21V 21/00* (2006.01)

(52) U.S. Cl. ..... 362/398; 362/183; 135/16
(58) Field of Classification Search ..... 362/120, 362/183, 398; 135/16
See application file for complete search history.

(56) References Cited

U.S. PATENT DOCUMENTS

| | | | | |
|---|---|---|---|---|
| 4,538,214 | A | 8/1985 | Fisher et al. | |
| 5,178,453 | A * | 1/1993 | Runels | 362/398 |
| 7,431,470 | B2 * | 10/2008 | Coleiro | 362/102 |
| 2006/0207637 | A1 * | 9/2006 | Coleiro | 135/18 |

FOREIGN PATENT DOCUMENTS

DE 202 16 867 U1 3/2003

* cited by examiner

*Primary Examiner*—John A Ward
(74) *Attorney, Agent, or Firm*—Leydig, Voit & Mayer, Ltd.

(57) ABSTRACT

A canopy lighting device comprising a body having a light source and a base that magnetically couples to the body. The body and the base can be located on opposite sides of a fabric sheet to magnetically clamp the lighting device to the fabric sheet. The base may have an energy source, first electrical connection features coupled electrically to the energy source, and first magnetic connection features. The body may have a light source, second magnetic connection features for cooperating with the first magnetic connection features to clamp the body to the bases and second electrical connection features. The second electrical connection features cooperate with the first electrical connection features of the base when the body and the base are clamped together.

9 Claims, 3 Drawing Sheets

CANOPY LIGHT

BACKGROUND TO THE INVENTION

1. Field of the Invention

The current invention relates to lights and more particularly to outdoor lights for use with canopies such as tents, awnings, umbrellas and the like. The invention also relates to solar powered lights.

2. Background Information

Outdoor events and functions are popular. At such outdoor events and functions it is common place to erect some kind of canopy to provide shade and/or shelter for guests or participants. The canopy may be an awning, tent or umbrella. Many such events are held in the afternoon and the evening and progress through until after the sun has set and so the need to provide lighting is common place.

A number of solutions to providing lighting under canopies are available. Lighting systems that secure to poles and structural members of the canopy system are common place and well-known. However such lighting systems have two problems identified by the current applicants. Firstly, many modern canopy systems have large unsupported areas of fabric which means that light must be located around the outside of such areas and must be bright in order to illuminate the whole area. If one wishes to have dim lighting at an event or function a few large bright light located along structural members of a canopy is not necessary suitable. Secondly, such lights are normally located below the canopy and so shaded from sunlight. Such an arrangement normally excludes the use of solar power lights that can charge up during sunlight hours for illumination after the sun has set.

SUMMARY OF THE INVENTION

Accordingly, there exists a need for an improved canopy light for use with a fabric structure such as tents, awnings, umbrellas and the like that overcomes or at least ameliorates the above two problems.

In view of the forgoing there is disclosed herein a canopy lighting device comprising a body and a base that magnetically couples to the body. The body has a light source. The body and based can be located on opposite sides of a fabric sheet to magnetically clamp the lighting device to the fabric. The base may have an energy source, first electrical connection features coupled electrically to the energy source and first magnetic connection features. The body may have a light source, second magnetic connection features for cooperating with the first magnetic connection features to clamp the body to the base and second electrical connection features. The second electrical connection features cooperate with the first electrical connection features of the base when the body and base are clamped together.

In order to magnetically couple the body and base, the body or base has a magnet and the other one of the body or base has a second magnet or a ferro- or ferri-magnetic member for attraction to the magnet. If each of the body and base comprises at least one magnet, the magnets are arranged to ensure orientation between the body and base when the magnets are magnetically coupled. Markings may be provided on the body and base to indicate when the body and base are aligned on the correct orientation.

The base may have an energy source, in which case there is an electrical coupling between the body and base for supplying energy from the energy source to the light source. The energy source preferably comprises a solar energy collector.

Further aspects and disclosure of the invention are provided in and will become apparent from the following description.

BRIEF DESCRIPTION OF THE DRAWINGS

An exemplary form of the present invention will now be described by way of example only and with reference to the accompanying drawings, in which.

DETAILED DESCRIPTION OF THE EXEMPLARY EMBODIMENTS

In the following description and claims the term canopy refers to any kind of cloth or fabric coverings that is suspended or supported to provide shade and/or shelter to one or more people. Such cloth or fabric coverings may be a tent, marquee, awning, sunshade, umbrella or the like.

Figure 1:
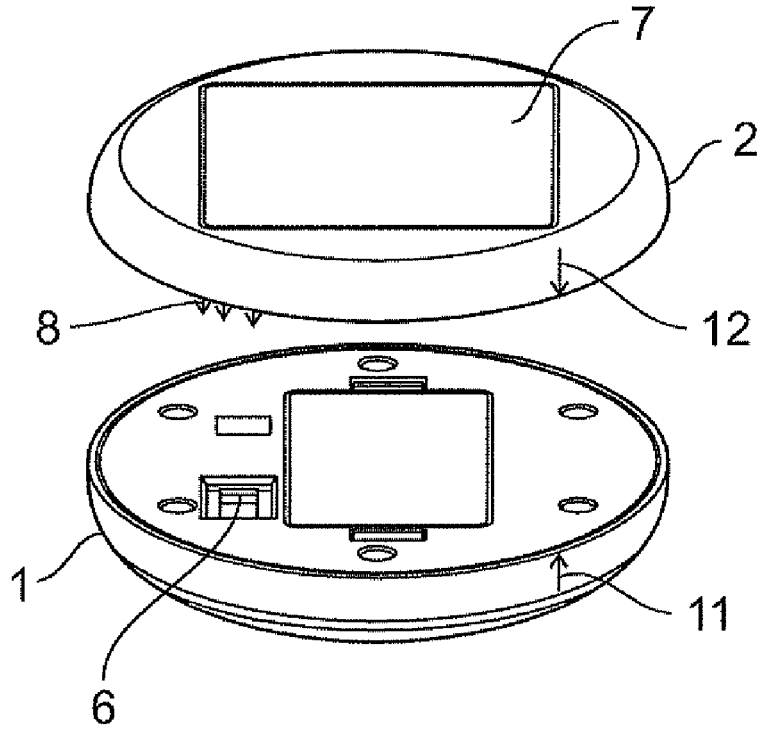
FIG. 1 is a schematic perspective view of a canopy lighting device according to the invention.
Figure 2:
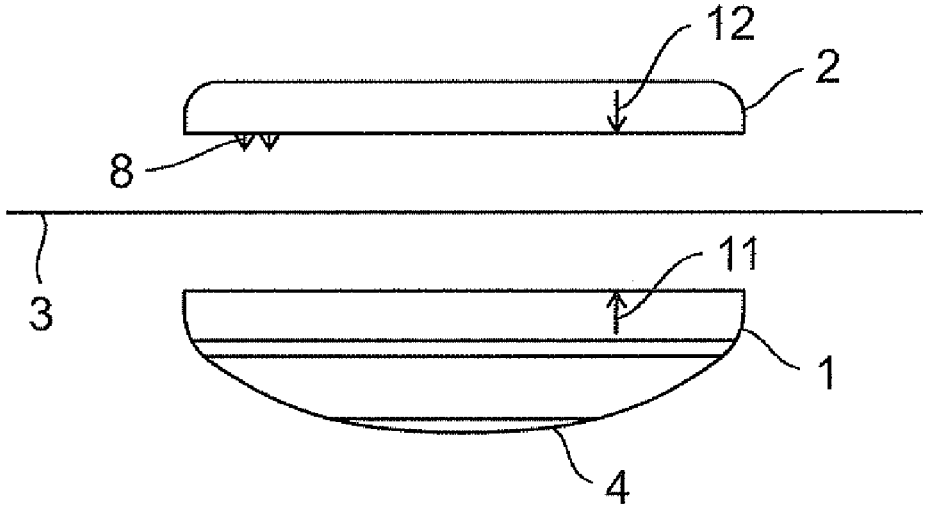
FIG. 2 is a 'separated' side view of the canopy lighting device.
Figure 3:
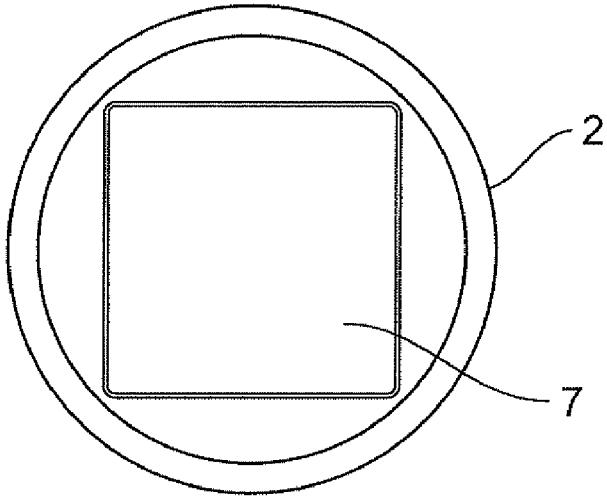
FIG. 3 is a top view of a base of the lighting device.
Figure 4:
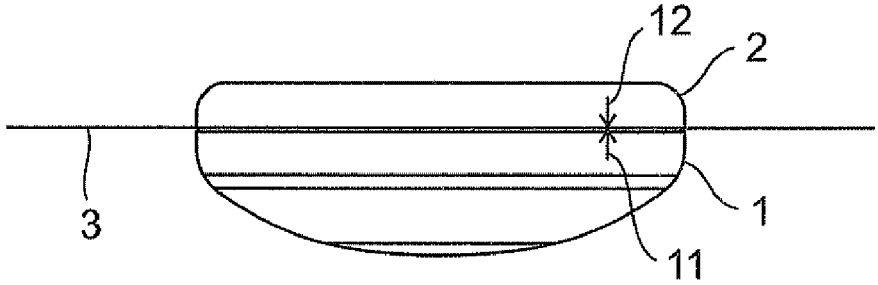
FIG. 4 is a 'coupled' side view of the canopy lighting device.
Figure 5:
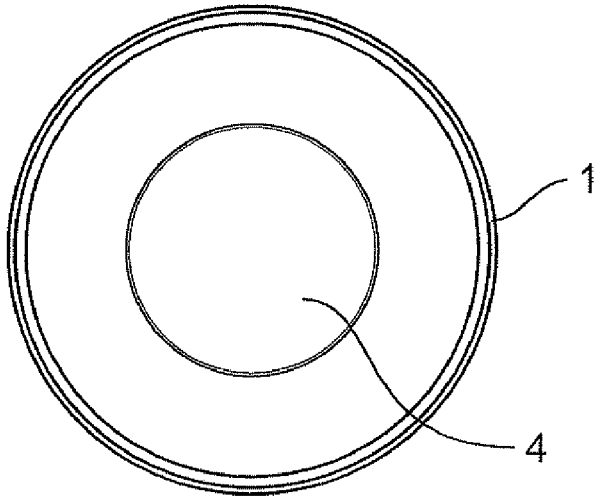
FIG. 5 is a bottom view of a body of the lighting device.
Figure 7:
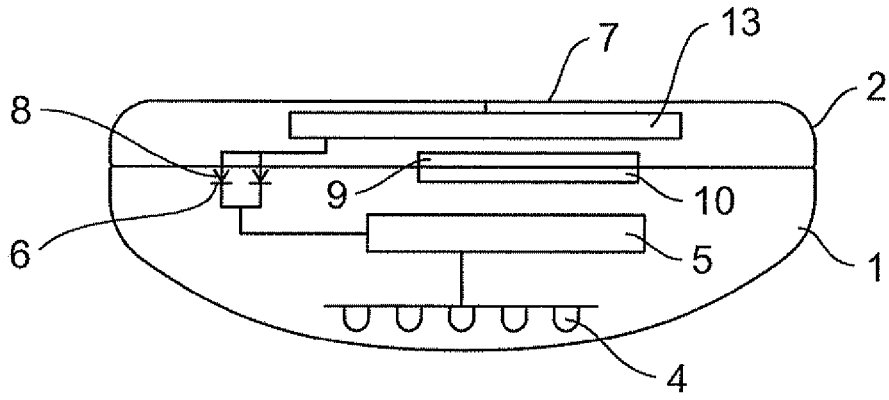
FIG. 7 is a second schematic section view through the lighting device.
Figure 6:
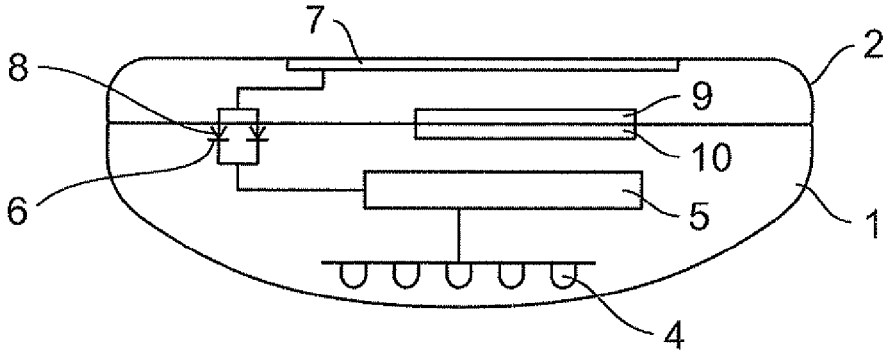
FIG. 6 is a first schematic section view through the lighting device.
Figure 8:
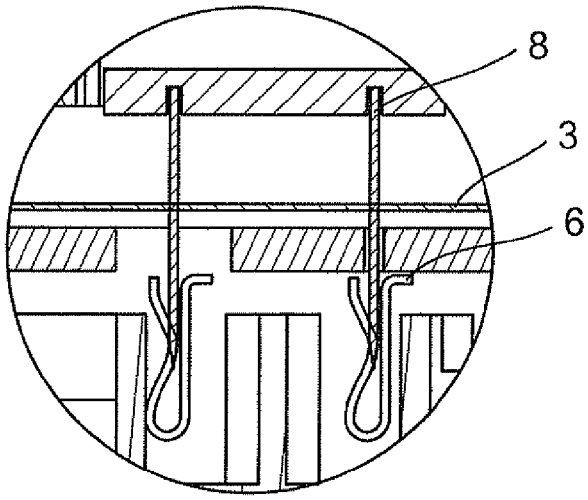
FIG. 8 is a view of one embodiment only of an electrical coupling between the body and base.

Referring to FIG. 1-6, in a preferred embodiment of the invention a solar power light comprises a body unit 1 and a base unit 2 that each has magnetic connection features 9, 10 so that the body and base units may be magnetically clamped together through a fabric sheet 3 of a canopy structure such as a tent, awning, umbrella or other covering of a like nature. The body unit 1 locates on a first, typically the underside, of the fabric sheet 3 and the base unit 2 locates adjacent the body unit 1 on the second, typically the top or upper side, of the fabric sheet 3. The magnetic coupling features clamp the fabric sheet 3 between the body and base units to hold the body and base units securely in place on the fabric sheet. Markings 11, 12 may be provided on the body and base respectively to indicate when the body and base are aligned on a correct orientation so that, for example, the electrical connection features mentioned below are aligned. The markings are arrows painted or printed to the sides of the body and base respectively.

The body unit comprises a disk shaped housing having on its first end surface the magnetic connection features of the body. In the preferred embodiment the body magnetic connection features 10 are is a magnet. On the second, in use the lower, surface of the body is an illumination source comprising a reflector, diffuser and lamp 4 for outputting light. The lamp 4 may be of any known type such as an incandescent lamp, fluorescent lamp, halogen lamp, LED and the like. In the preferred embodiment the lamp is an LED because of its high output luminance and low power consumption. A rechargeable battery 5 is located in the body 1 housing for supplying energy to the lamp 4. A switch means (not shown), which may be a mechanical or electric switch or light sensor, is provided for turning the lamp 4 on and off as needs be. A pair of terminals 6 is also provided on the first end surface of the body 1 housing for receiving energy for charging the battery 5. The battery 5 is electrically connected to the terminals via a charging circuit (not shown), the configuration of which should be well-known in the art.

The base unit 2 comprises a second disk shaped housing, which preferable has a lower profile than the body housing. On the first, in use the lower, side of the base housing is second magnetic connection features 9, which in the preferred embodiment is a second magnetic that complimentary to the first magnetic so that the two magnets magnetically attractive to clamp the body and base housings together, and a pair of protruding pins. On the top surface of the base housing is a solar panel 7 for collecting solar energy. The solar panel is connected with the pair of pins 8 protruding from the underside of the base housing. The pins 8 are pointed so that when the body and base units are clamped together the pins penetrate (pierce) through the fabric sheet and engage the terminals 6 of the body unit for supplying energy from the solar panel to the battery of the body unit.

In the preferred embodiment, illustrated, it will be apparent that a particular orientation of the body and base units is required when clamped together so that the pins of the base correctly engaged with the terminals of the body. Orientation of the base and body when clamped together can be required by arrangement of the magnets in the body and base units. In the preferred embodiment the magnets are elongate bar magnets having north and south poles at their respective ends. The magnets are laid parallel to the plane of the respective surfaces of the body and base units that are in juxtaposition when the body and base are clamped together. The magnet in the base unit is positioned complimentary to the magnet in the body unit. As will be apparent to the skilled addressee, the north pole of the base magnet is attracted to the south pole of the body magnet, and visa versa, so that the body and base unit will only clamp together with a certain orientation that so aligns the magnets. The magnets bring the body and base together in the orientation when positioned adjacent each other on opposite sides of the fabric sheet of the canopy to which the lighting device is being clamped.

In use, the afore described lighting device is clamped to the canopy of a tent, awning, umbrella or the like with the body unit on the underside of the canopy and the base unit on the top or upper side of the canopy. The magnetic connection features of the body and base units clamp the fabric sheet of the canopy between the units holding the lighting device firmly in place. The pins of the base unit penetrate the canopy fabric and engage the terminals of the body unit to electrically connect the base and body units. During daylight hours the solar panel collects solar energy which is transferred through these electrical connection features (i.e. the contact pins and terminals) to charge the body unit battery. During darkness hours the user may activate the light source via a switch, or the light source automatically activates via a daylight sensor, in order to illuminate the lamp by drawing energy stored in the battery. Such a lighting device may be placed at any location on a canopy regardless of poles or other structural elements of the canopy and can draw energy from the sun above the canopy, during daylight hours, while illuminating the area under the canopy.

A particular embodiment of the invention has been described however this is not intended to limit the scope of use and functionality of the invention and certain modifications to the preferred embodiment are envisaged In the preferred embodiment the magnetic connection features of the body and base units are complimentary magnets arranged and located to clamp the body and base together in a certain orientation (alignment). In an alternative embodiment of the invention two or three smaller discs type magnets are located in respective complimentary north/south pole pairs at positions in each of the body and base units to achieve clamping and orientation of the body and base units. Alternatively, in another embodiment only one of the body or base units has as its magnetic connection features a permanent magnet. The other units have as their magnetic connection features an area of ferromagnetic or ferrimagnetic material for attraction of the permanent magnet of the other unit. As the skilled addressee will appreciate, two or more magnets and corresponding ferromagnetic or ferrimagnetic connection pads can be located at positions in each of the body and base units to achieve clamping and orientation of the body and base units.

In the preferred embodiment electrical connection features of the body and base units comprise a pair of terminals and a complimentary pair of pointed pins for penetrating the fabric and engaging with the terminals. Some users may prefer not to have pointed pins penetrating the fabrics of their canopy and so in an alternative embodiment the pins of the base unit are retractable so that the lighting device may be located on a canopy without damaging the canopy fabric. The pins may be retractable by manual operation (retraction) of the pins may be blunt and lightly spring loaded to be pushed back by the fabric when the body and base are clamped together without damaging the fabric. The skilled addressee will realize that without the pins penetrating the fabric the battery of the body cannot be charged by the solar panel. The user may extend the pins and clamp the body and base units together without securing the lighting device to a canopy and then by leaving the lighting device exposed to solar energy may charge the battery of the body unit. When the sun goes down and the user desires light the user may separate the base and body, retract the pins and clamp the lighting device to the canopy fabric for illuminating the area under the canopy.

Alternative to using pins and terminals as electrical connection features yet a further alternative embodiment has inductive coupling for contactless transmission of energy between the base and body units. An inductive coupling arrangement should be well-known to those in the art. Because the fabric sheet of any canopy such as a tent, awning or umbrella upon which the device is used is relatively thin, say less than 1 mm, the features of the inductive coupling element are very close to achieve efficient energy transfer.

In yet a further embodiment of the invention the body unit has a simple a self-contained energy source and the base unit is simply a body having magnetic connection features for the sole function of clamping the body unit to a canopy. The self-contained energy source may be replaceable batteries or rechargeable batteries that recharged by connection of the body unit to a mains-power supply or via solar energy from a solar panel located on an upper surface of the body unit.

In the preferred embodiment the energy source of the base unit is a solar panel which is used to charge a battery within the body unit via electrical connection features between the base and body units. In yet another alternative embodiment the base unit has its own battery 13 so that the base unit can store electrical energy converted from solar energy when it is not so clamped to the body unit. Energy stored in a battery of the base unit is subsequently used to charge the body unit battery or to supply energy directly to the lamp once the base unit is clamped to the body unit.

It should be appreciated that only preferred embodiments of the invention have been described. Further embodiments obvious to those skilled in the art are not to be considered as beyond the scope of the present invention.

What is claimed is:

1. A canopy lighting device comprising:

a body including a light source, first electrical connection means, and a first elongate bar magnet having a north pole and a south pole; and a base including an energy source, a second elongate bar magnet having a north pole and a south pole that magnetically couples to the first elongate bar magnet in the body with the respective north and south poles coupled in pairs, so that the body and the base have a fixed rotational orientation with respect to each other, when magnetically coupled and located on opposite sides of a fabric sheet with the lighting device clamped to the fabric sheet, and second electrical connection means cooperating with the first electrical connection means when the body and the base are magnetically coupled to each other, wherein the first and second electrical connection means comprise terminals and pins, and the pins are retractable.

2. The lighting device of claim 1, wherein the energy source comprises a solar energy collector.

3. The lighting device of claim 2, wherein the body includes a battery for supplying energy to the light source, and that can be charged from the solar energy collector when the body and the base are magnetically coupled to each other.

4. The lighting device of claim 1, wherein the pins are pointed for penetrating a fabric sheet when the body and the base of the lighting device are magnetically coupled to each other on opposite sides of the fabric sheet.

5. The lighting device of claim 1, wherein the energy source supplies energy to the light source when the body and the base are magnetically coupled to each other.

6. The lighting device of claim 1, wherein the energy source comprises a battery.

7. The lighting device of claim 1, wherein the first and second electrical connection means comprise a contactless coupling for transmitting energy from the base to the body when the body and the base are magnetically coupled to each other.

8. The lighting device of claim 7, wherein the contactless coupling comprises inductive coupling.

9. A solar power canopy light comprising:

a base including a solar energy collector, first electrical connection means coupled electrically to the solar energy collector, and a first elongate bar magnet having a north pole and a south pole; and a body including a light source, a battery for supplying energy to the light source, a second elongate bar magnet having north and south poles and that magnetically couples to the first elongate bar magnet in the body with respective north and south poles coupled in pairs so that the body and the base have a fixed rotational orientation with respect to each other when magnetically coupled, and second electrical connection means cooperating with the first electrical connection means of the base for charging the battery from the solar energy collector when the body and the base are magnetically coupled to each other, wherein the second electrical connection means is retractable.

* * * * *